US009032938B2

(12) United States Patent
Harris et al.

(10) Patent No.: US 9,032,938 B2
(45) Date of Patent: May 19, 2015

(54) IN-CYLINDER CHARGING SYSTEM FOR FUEL DELIVERY SYSTEMS AND METHODS

(71) Applicant: Enginetics, LLC, Miami Beach, FL (US)

(72) Inventors: Roderick Harris, Northville, MI (US); Joseph Lull, South Haven, MI (US); Justin Warner, Milford, MI (US)

(73) Assignee: ENGINETICS, LLC, Fernandina, FL (US)

( * ) Notice: Subject to any disclaimer, the term of this patent is extended or adjusted under 35 U.S.C. 154(b) by 245 days.

(21) Appl. No.: 13/626,716

(22) Filed: Sep. 25, 2012

(65) Prior Publication Data

US 2014/0083395 A1 Mar. 27, 2014

(51) Int. Cl.

| | |
|---|---|
| ***F02D 41/00*** | (2006.01) |
| ***F02M 25/00*** | (2006.01) |
| *F02D 43/00* | (2006.01) |

(52) U.S. Cl.

CPC ..... *F02D 41/0025* (2013.01); *F02M 25/00* (2013.01)

(58) Field of Classification Search

CPC ..... F02M 25/00; F02D 41/0025; F02D 43/00
USPC ..... 123/447, 531, 532, 585, 179.21, DIG. 7, 123/327; 239/8; 701/113; 60/611
See application file for complete search history.

(56) References Cited

U.S. PATENT DOCUMENTS

| | | | | |
|---|---|---|---|---|
| 2,522,456 | A * | 9/1950 | Mallory | 123/585 |
| 2,693,311 | A | 11/1954 | Kratzer | |
| 2,696,343 | A * | 12/1954 | Mallory | 417/364 |
| 2,818,931 | A | 1/1958 | Mallory | |
| 2,867,375 | A | 1/1959 | Petersen | |
| 3,963,379 | A * | 6/1976 | Ueno | 417/237 |
| 4,210,062 | A * | 7/1980 | Plesko | 91/54 |
| 4,741,164 | A | 5/1988 | Slaughter | |
| 5,529,549 | A | 6/1996 | Moyer | |
| 5,997,259 | A | 12/1999 | Marshall et al. | |
| 6,109,886 | A * | 8/2000 | Schonfeld et al. | 417/298 |
| 2003/0140911 | A1* | 7/2003 | Lo | 123/585 |
| 2005/0166592 | A1* | 8/2005 | Larson et al. | 60/611 |
| 2007/0246008 | A1* | 10/2007 | Gerum | 123/316 |
| 2010/0122687 | A1* | 5/2010 | Gerum et al. | 123/327 |
| 2010/0270097 | A1 | 10/2010 | Prakash et al. | |
| 2010/0307440 | A1* | 12/2010 | Ma et al. | 123/179.3 |
| 2011/0144894 | A1* | 6/2011 | Marriott et al. | 701/113 |
| 2011/0284652 | A1 | 11/2011 | Amaya et al. | |

OTHER PUBLICATIONS

PCT International Search Report for International Application No. PCT/US2013/058701, mailed Feb. 3, 2014 (2 pp.).

* cited by examiner

*Primary Examiner* — Mahmoud Gimie
(74) *Attorney, Agent, or Firm* — Holland & Hart

(57) ABSTRACT

An air charging system includes a valve providing access to an engine cylinder, an accumulator coupled in flow communication with the valve, and a controller operable to open and close the valve until a threshold pressure condition is reached in the accumulator. Compressed gases stored in the accumulator are used in a fuel delivery system to prepare a charge of fuel that is delivered to an engine.

21 Claims, 8 Drawing Sheets

IN-CYLINDER CHARGING SYSTEM FOR FUEL DELIVERY SYSTEMS AND METHODS

TECHNICAL FIELD

The present disclosure is directed to fuel systems, and more particularly directed to providing compressed gas for fuel delivery systems that use multiple fluids to deliver fuel to an engine.

BACKGROUND

Many types of devices have been developed over the years for the purpose of converting liquids into aerosols or fine particles readily converted into a gas-phase. Many such devices have been developed, for example, to prepare fuel for use in internal combustion engines. To optimize fuel oxidation within an engine's combustion chamber, the fuel must be vaporized, homogenized with oxidizer (e.g. air), and in a chemically-stoichiometric gas-phase mixture. Ideal fuel atomization and vaporization enables more complete combustion and consequent lower engine out pollution. In the case of underwater or high altitude engine operation, the oxidant may more effectively be of another fluid (gas or liquid). In special service applications, the oxidant is selected based upon its efficacy for combustion irrespective of costs. Another factor of oxidant selection is mass per oxidizing unit (e.g., hydrogen peroxide etc.).

More specifically, relative to internal combustion engines, stoichiometricity is a condition where the amount of oxidant required to completely burn a given amount of fuel is supplied in a homogeneous mixture resulting in optimally correct combustion with no residues remaining from incomplete or inefficient oxidation. Ideally, the fuel should be completely vaporized, intermixed with air, and homogenized prior to ignition for proper oxidation. Non-vaporized fuel droplets do not ignite or combust completely in conventional internal and external combustion engines, which degrades fuel efficiency and increases engine out pollution.

Attempts to reduce or control emission byproducts by adjusting temperature and pressure typically affects the $NO_x$ byproduct. To meet emission standards, these residues must be dealt with, typically requiring after treatment in a catalytic converter or a scrubber. Such treatment of these residues results in additional fuel costs to operate the catalytic converter or scrubber and may require additional component costs as well as packaging and mass implications. Accordingly, any reduction in engine out residuals resulting from incomplete combustion would be economically and environmentally beneficial.

Aside from the problems discussed above, a fuel that is not completely vaporized in a chemically stoichiometric air/fuel mixture causes the combustion engine to perform at less than peak efficiency. A smaller portion of the fuel's chemical energy is converted to mechanical energy when fuel is not completely combusted. Fuel energy is wasted and unnecessary pollution is created. Thus, by further breaking down and more completely vaporizing the fuel-air mixture, better fuel efficiency may be available.

Many attempts have been made to alleviate the above-described problems with respect to fuel vaporization and incomplete fuel combustion. In automobile engines, for example, inlet port or direct fuel injection have almost universally replaced carburetion for fuel delivery. Fuel injectors spray fuel directly into the inlet port or cylinder of the engine and are controlled electronically. Injectors facilitate more precise metering and control of the amount of fuel delivered to each cylinder independently relative to carburetion. This reduces or eliminates charge transport time facilitating optimal transient operation. Nevertheless, the fuel droplet size of a fuel injector spray is not optimal and there is little time for the fuel to mix with air prior to ignition.

Some types of fuel delivery systems require a source of compressed air to properly delivery fuel to the cylinder for combustion. The compressed air is typically provided by the engine, a compressor component operated by the engine, or electrically off-board of the engine. Challenges exist related in providing a source of compressed air for the fuel delivery system when starting the engine before the compressor is operating.

SUMMARY

The principles described herein may address some of the above-described deficiencies and others. One aspect provides an air charging system that includes a valve providing access to an engine cylinder, an accumulator coupled in flow communication with the valve, and a controller operable to open and close the valve until a threshold pressure condition is reached in the accumulator.

The valve may include a poppet valve. The poppet valve may be biased into a closed position. The controller may open the valve during a compression cycle during the engine start cycle. The controller may operate to control flow of compressed air stored in the accumulator to a fuel delivery system. The accumulator may include a storage tank. The accumulator may hold a volume of compressed air sufficient for at least one engine firing sequence. The valve may include a poppet valve opening in the cylinder that is arranged outward opening. The charging system may include a solenoid configured to move the valve between opened and closed positions.

Another aspect of the present disclosure relates to a method of scavenging compressed air from an engine cylinder. The method includes providing a valve and an accumulator, wherein the valve provides access to the engine cylinder and the accumulator is coupled in flow communication with the valve. The method also includes opening the valve during an engine compression stroke, collecting compressed air from the cylinder into the accumulator while the valve is opened, and storing the compressed air in the accumulator for use in a fuel delivery system.

The method may also include closing the valve upon reaching a predetermined pressure condition in the accumulator. The method may include closing the valve upon completion of the engine compression stroke. The valve may include a valve opening directly into the cylinder, a valve seat positioned within the cylinder, and a poppet valve movable into and out of sealing contact with the valve seat. The method may include biasing the valve into a closed position.

Another method in accordance with the present disclosure relates to a method of starting an engine. The method includes providing an air charging system and a fuel delivery system, wherein the air charging system includes a valve configured to access a power cylinder of the engine, and an accumulator connected in flow communication with the valve and the fuel delivery system. The method includes opening the valve during a compression cycle of the engine, collecting compressed air from the cylinder into the accumulator, delivering the compressed air from the accumulator to the fuel delivery system, and delivering fuel from the fuel delivery system to the cylinder to start the engine.

The method may include closing the valve after completing the compression cycle of the engine. The method may include closing the valve after a predetermined pressure condition is reached in the accumulator. The method may include delivering the compressed air to the fuel delivery system only after a predetermined pressure condition is reached in the accumulator. The method may include shutting off the compressed air from the accumulator to the fuel delivery system after the engine is started. The method may further include using multiple compression cycles of the engine to reach the predetermined pressure condition in the accumulator. The method may also include providing a solenoid to operate the valve between opened and closed positions based on a compression cycle of the cylinder and a pressure condition in the accumulator.

BRIEF DESCRIPTION OF THE DRAWINGS

The accompanying drawings illustrate certain embodiments discussed below and are a part of the specification.

Throughout the drawings, identical reference characters and descriptions indicate similar, but not necessarily identical elements.

DETAILED DESCRIPTION

Figure 1:
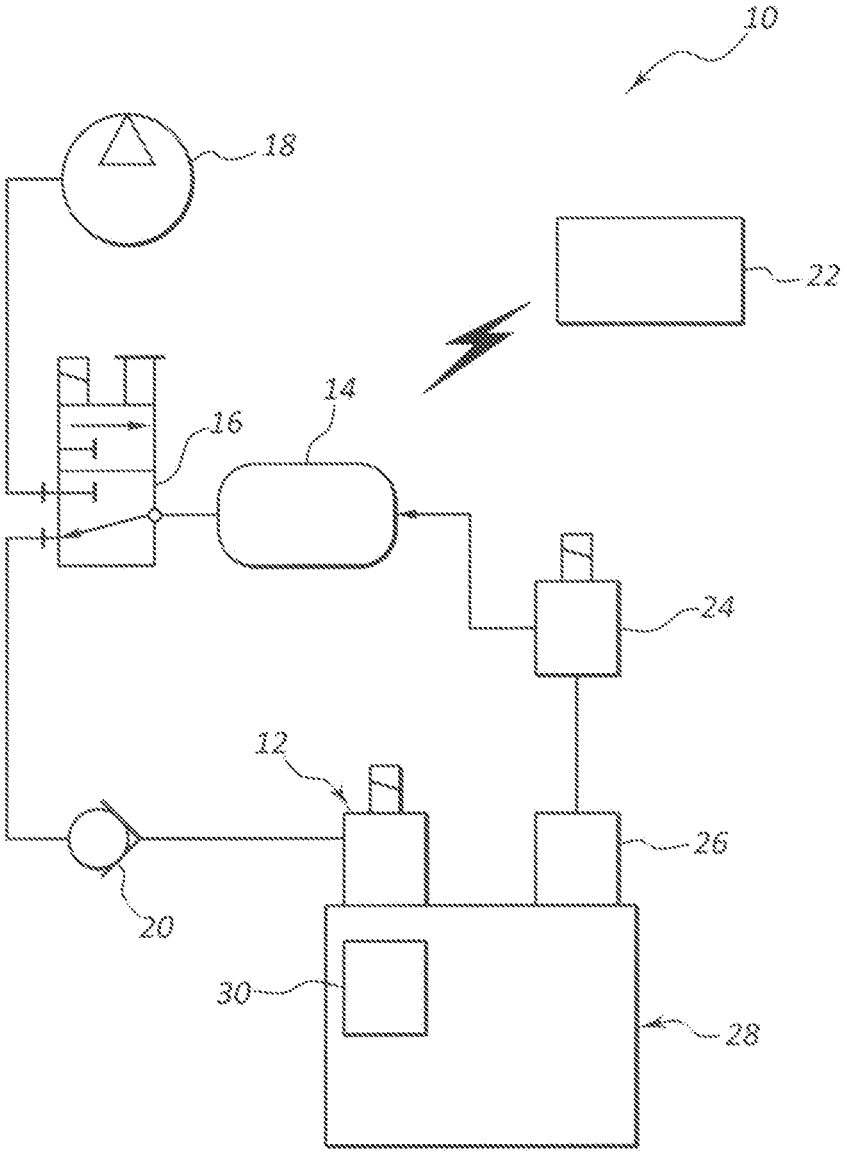
FIG. 1 is a schematic diagram showing an example air charging system in accordance with the present disclosure.

Illustrative embodiments and aspects are described below. It will, of course, be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present disclosure is directed to fuel preparation systems and methods, and related systems and methods for creating charged air that is used for the fuel preparation system. One type of fuel preparation system has a dual fluids input, wherein one of the fluids is gas (e.g., air) and the other fluid is a liquid (e.g., liquid fuel such as gasoline). A supply of the gas is needed to commence operation of the fuel preparation system in order to deliver a prepared fuel charge to the engine for starting the engine. Once the engine is running, a mechanically or electrically driven compressor may assume the task of providing a source of the compressed gas to the fuel preparation system. The supply of compressed gas prior to starting the engine may be provided using, for example, a charge accumulator tank, a converter, a reformer, or other charge supply device.

An example air charging system in accordance with the present disclosure collects compressed air from a cylinder of the engine during a compression stroke of an initial engine rotation while the engine is cranking for startup. The compressed air is stored in an accumulator to provide sufficient air volume for operating the fuel preparation system to start the engine. At least one compression cycle may be required to sufficiently charge the air charging system to provide adequate air volume for starting the engine. Air pressure within the accumulator may be monitored during engine start cranking to determine when the firing sequence may commence (e.g., delivery of fuel from a fuel preparation system). Once the engine begins firing, an engine driven or off-engine compressor may assume responsibility for providing compressed air to the fuel preparation system. In one example, a variable displacement compressor may be applied at transient engine demand volumes—thus reducing parasitic losses at lower volumes.

The example air charging systems disclosed herein may operate to scavenge gases (e.g., air) from a power cylinder of an engine during engine start cranking. The scavenged compressed air may be used with a fuel preparation system such as a dual fluid injection system to start the engine. An example dual fluid injection system and related methods is disclosed in U.S. Patent Publication No. 2011/0284652, which is incorporated herein in its entirety by this reference.

An example air charging system in accordance with the present disclosure includes a charge valve assembly, an accumulator, a control valve and a controller (e.g., an engine control unit (ECU)). The charge valve assembly may include a valve member (e.g., a poppet valve) that provides access into a power cylinder combustion chamber of the engine. Compressed air is extracted from the engine power cylinder through the charge valve assembly during a compression cycle of the engine. The compressed air is stored in the accumulator. The charge valve assembly operates between open and closed positions to collect the compressed air from the engine power cylinder (typically during the compression stroke). Air may be collected from the power cylinder compression stroke in multiple cycles until a threshold pressure is reached in the accumulator. The controller then initiates an engine starting sequence in which compressed air from the accumulator is delivered to an air metering device that supplies compressed air to a fuel delivery device, which delivers fuel to the engine. Once the engine is started, the control valve switches from the accumulator to a compressor that operates under power of the engine, either mechanically or electrically, for supply of compressed air to the air metering device.

Referring now to FIG. 1, a schematic diagram of an example air charging system 10 is shown including a charge valve assembly 12, an accumulator 14, a control valve 16, a compressor 18, a one-way valve 20, a controller 22 and an air metering device 24. The charge valve assembly 12 provides flow of gases from the engine cylinder 30. The gases accessed using the charge valve assembly 12 travel through the one-way valve 20 to the control valve 16. The control valve 16 controls flow of the gases to the accumulator 14. The accumulator 14 is coupled to the air metering device 24. The air metering device 24 controls flow rate and pressure of the air delivered to fuel delivery device 26. The air metering device 24 may include a regulator valve (e.g., a preset or variable valve). The regulator valve may be variable via, for example, the engine control unit (ECU) based on system parameters or duty cycle/demand. The fuel delivery device 26 uses the compressed air from air metering device 24 to generate a fuel charge and deliver the fuel charge to the engine 28. The control valve 16 may operate between a position in which gases flow from the charge valve assembly 12 to the air metering device 24 and a position where air flows from the compressor 18 to the air metering device 24.

Figure 4A:
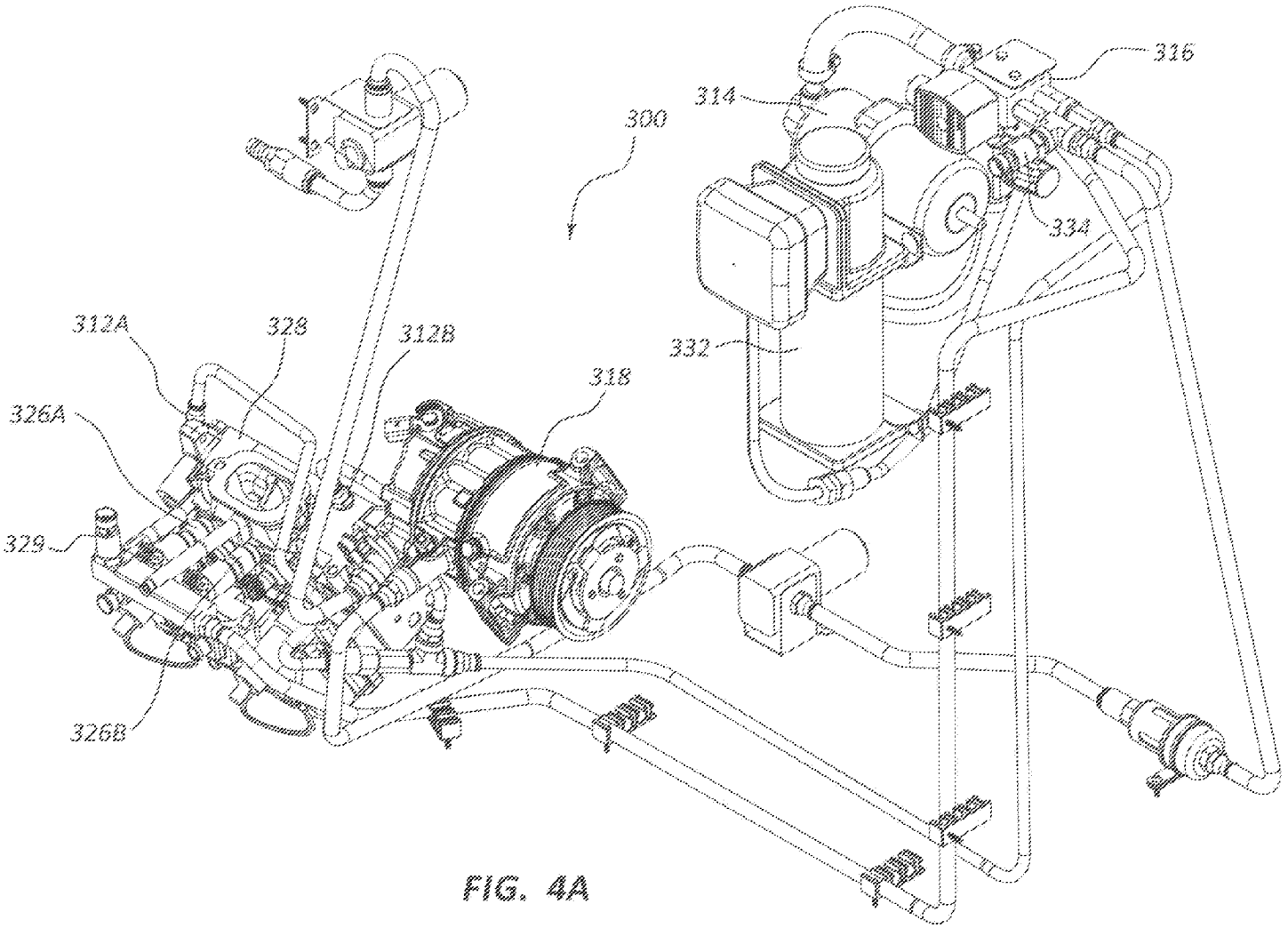
FIGS. 4A and 4B are perspective views of an example air charging system vehicle package in accordance with the present disclosure.

The controller 22 may control operation of a plurality of features of air charging system 10. For example, controller 22 may receive sensor signals from engine 28 related to a position of the piston in engine cylinder 30 to help determine when the charge valve assembly 12 should be operated between opened and closed positions. Sensor signals from the air system (e.g., from sensor 329 on the air supply rail, manifold or other portion of the system as shown in FIG. 4A, which directly communicate air system information) related to the pressure condition within, for example, accumulator 14 and the operated position of the control valve 16, may also be used by controller 22 to help determine, for example, when to initiate an ignition cycle by delivering compressed air from the air metering device 24 to the fuel delivery device 26. Typically, the control valve 16 operates to provide flow of communication between accumulator 14 and compressor 18 only after the engine 28 has started and the compressor 18 is operating to generate compressed air.

Figure 5A:
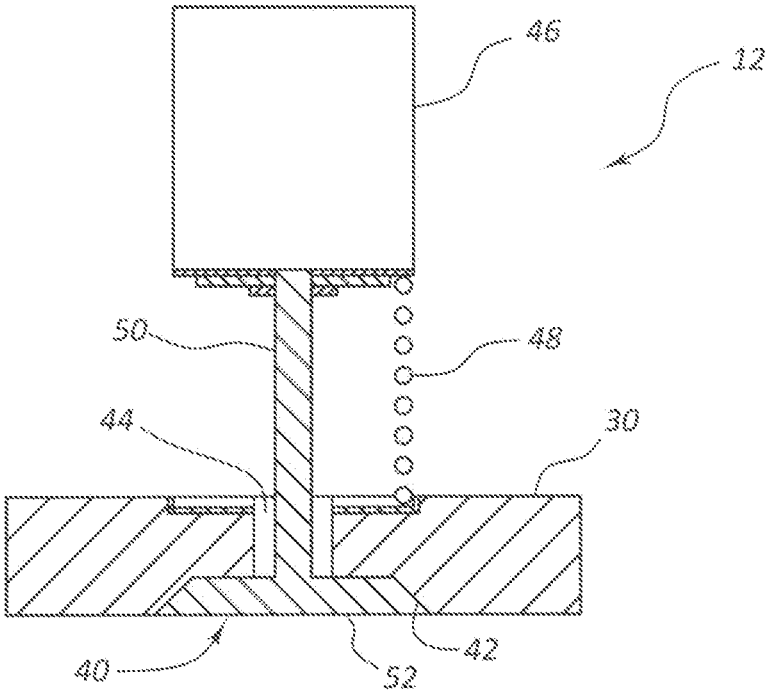
FIGS. 5A and 5B are cross-sectional views of an example valve assembly in accordance with the present disclosure arranged in closed and open positions, respectively.
Figure 5B:
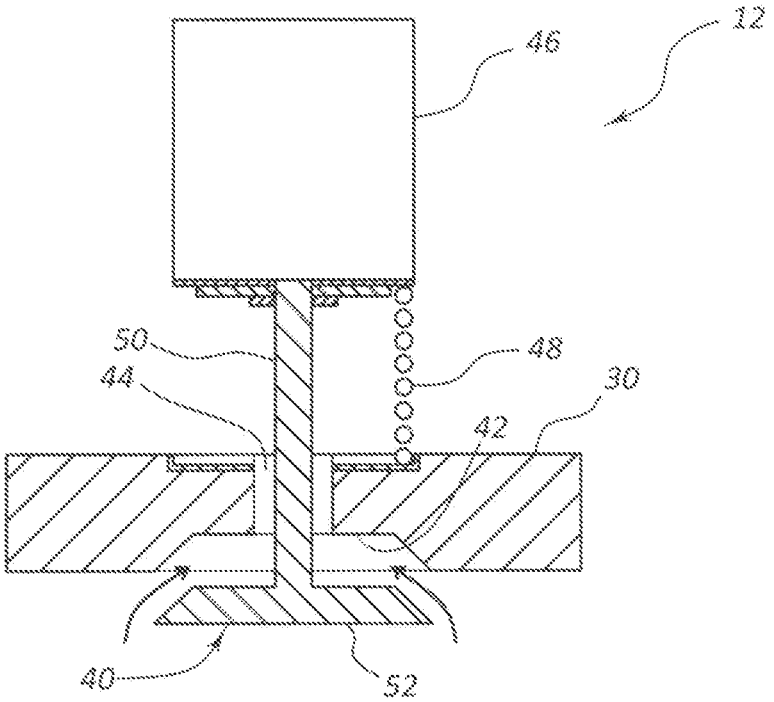

Referring to FIGS. 5A and 5B, an example charge valve assembly 12 is shown and described in further detail. The charge valve assembly 12 includes a valve member 40, a valve seat 42, a valve opening 44, a solenoid 46, and a biasing member 48. The valve member 40 includes a stem 50 and a head 52. The head 52 seals against the valve seat 42 when the charge valve assembly 12 is in a closed position as shown in FIG. 5A. Operating the solenoid 46 moves the head 52 away from the valve seat 42 to permit flow of gases (e.g., air) through the valve opening 44 as shown in FIG. 5B. The biasing member 48 biases the head 52 into the closed position of FIG. 5A.

The charge valve assembly 12 shown in FIGS. 5A and 5B is typically referred to as a poppet valve or poppet valve assembly. Other types of valves may be used in place of a poppet valve such as, for example, a rotary valve. Poppet valves typically provide the advantage of minimum weight requirement, a generally reliable seal at the interface of the head 52 and valve seat 42, and a failure mode into a closed position by operation of the biasing member 48. Further, the poppet valve does not require alteration of the combustion chamber geometry. The poppet valve opens into the combustion chamber in an outward direction, thereby permitting maximum air flow around the valve member 40 and through the valve opening 44 for use by the air charging system 10. Further, the poppet valve may maintain a relatively tight seal when the engine is firing and the piston is moving because the top of the head 52 is forced back into the valve seat 42.

As noted above, a sensor may be used to determine a position of the piston operating in engine cylinder 30. The controller 22 operates the charge valve assembly 12 between closed and opened positions based on a position of the piston operating within engine cylinder 30 (e.g., a crank position). A plurality of sensors may be used, wherein one sensor indicates a crank position while another sensor determines which cycle the cylinder is in. Typically, the charge valve assembly 12 is operated into an open position during a compression stroke and is closed during the remaining crank positions. The charge valve assembly 12 may be opened and closed several times (e.g., an opening cycle) in order to obtain the amount of compressed air in accumulator 14 needed to operate the fuel delivery device 26.

Figure 3:
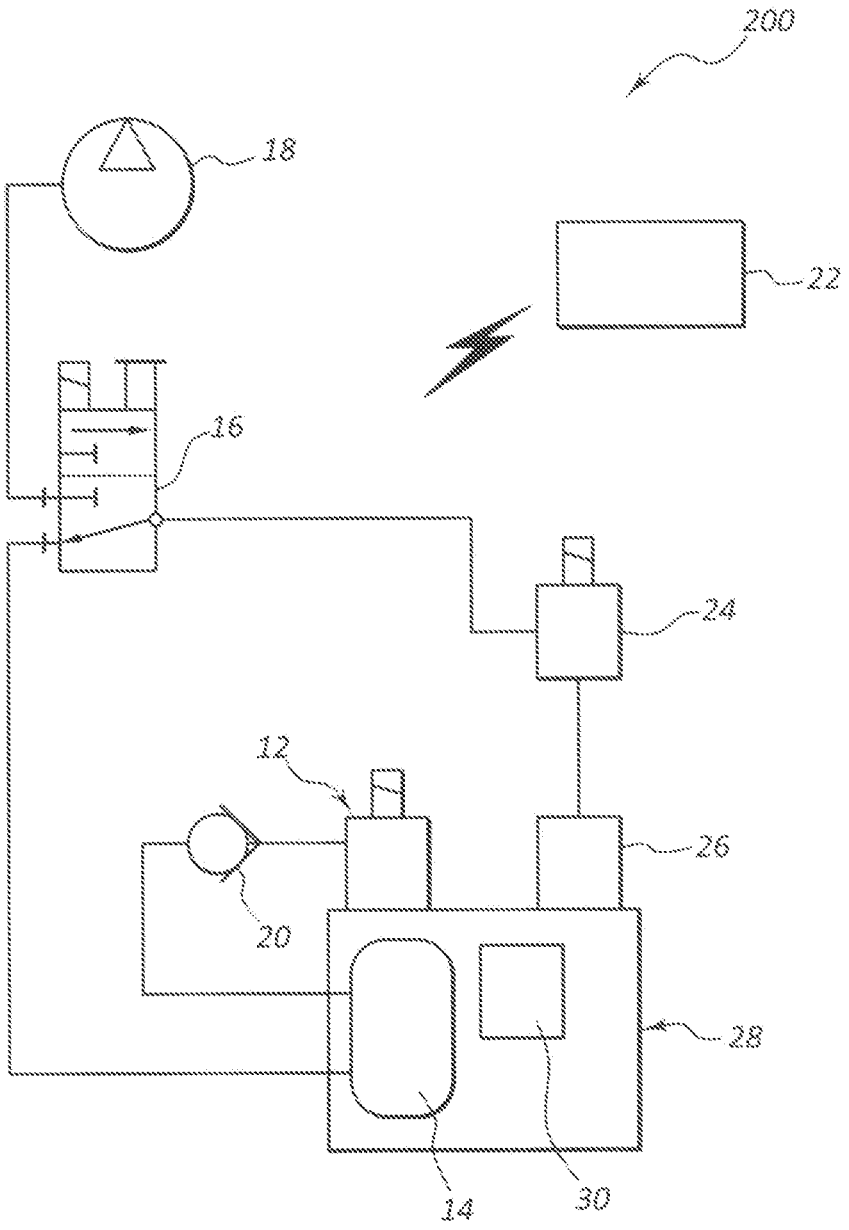
FIG. 3 is a schematic diagram showing another example air charging system in accordance with the present disclosure.

The accumulator 14 may have any desired shape, size, and volume. The accumulator 14 may be a separately formed structure that is mounted outside of engine 28. In an alternative configuration, the accumulator 14 is integrated into the engine 28, such as being formed (e.g., cast) into a portion of the engine block or head. FIG. 3 shows an example air charging system 200 that includes the accumulator 14 integrated into engine 28. In other arrangements, the accumulator 14 is provided as a separate component. At least one sensor may be associated with accumulator 14 to determine a pressure condition within the accumulator 14. An example accumulator 14 may have a volume in the range of about 1 L to about 3 L, and more preferably about 2 L for a multicylinder engine of 4 cylinders.

The control valve 16 may be, for example and without limitation, a three-way valve or a shuttle valve. A control valve 16 operates between a first position in which gases flow from the charge valve assembly 12 to accumulator 14, and a second position in which the flow path from the charge valve assembly 12 to the accumulator 14 is closed and a separate flow path between the compressor 18 and the accumulator 14 is opened. The control valve 16 may be operated between the first and second positions based on, for example, a pressure condition sensed within accumulator 14, an operating state of compressor 18, and an operating condition of engine 28.

The compressor 18 may be a mechanically driven or electric compressor. A mechanically driven compressor 18 is typically operable after the engine 28 has started and is powered by engine 28. An electric compressor may operate using power generated by engine 28 or may draw power from a different power source such as batteries that are independent of engine operation. Using a mechanically driven compressor 18 may provide a low cost, low weight, simple option for providing the minimum requirements for compressed air for the fuel delivery device 26.

The one-way valve 20 is positioned in the flow line between the charge valve assembly 12 and the accumulator 14 or control valve 16. The one-way valve 20 helps prevent backflow of compressed air collected from the charge valve assembly 12.

The controller 22 may be part of an engine control unit (ECU). The controller 22 may receive inputs from a variety of sensors of the air exchange system 10 and engine 28, and receive feedback concerning operation of various components of the air charging system 10, fuel delivery device 26 and engine 28. At a minimum, the controller 22 typically controls operation of the charge valve assembly 12 between opened and closed positions, controls operation of the control valve 16 between first and second positions, and controls delivery of compressed air stored in accumulator 14 or delivered from compressor 18 to the air metering device 24. The controller 22 may provide other operations and related methods for the air charging system 10.

The air metering device 24 may regulate the flow rate and pressure condition of compressed air stored in the accumulator 14 that is delivered to the fuel delivery device 26. In one example, the air metering device 24 provides a flow of air at a pressure of about 4 Bar/58 psi to about 6 Bar/87 psi and at a flow rate of about 2.2 kg/hr to about 22 kg/hr.

In the arrangement shown in FIG. 1 the accumulator 14 may act as a buffer for the compressed air being delivered from either the charge valve assembly 12 or the compressor 18 to the air metering device 24. In one example, compressed air supplied via the charge valve assembly 12 may be delivered to the accumulator 14 in short bursts collected during the compression cycle of the engine until a threshold pressure condition is reached in accumulator 14. The compressor 18 may have a compressed air output that modulates based on, for example, an operating condition of engine 28. The accumulator 14 may regulate or buffer the peak and valley pressures delivered from the source of air pressure (e.g., the engine cylinder 30 or compressor 18) so that conditions of the compressed air delivered to the air metering device 24 are relatively consistent.

Figure 2:
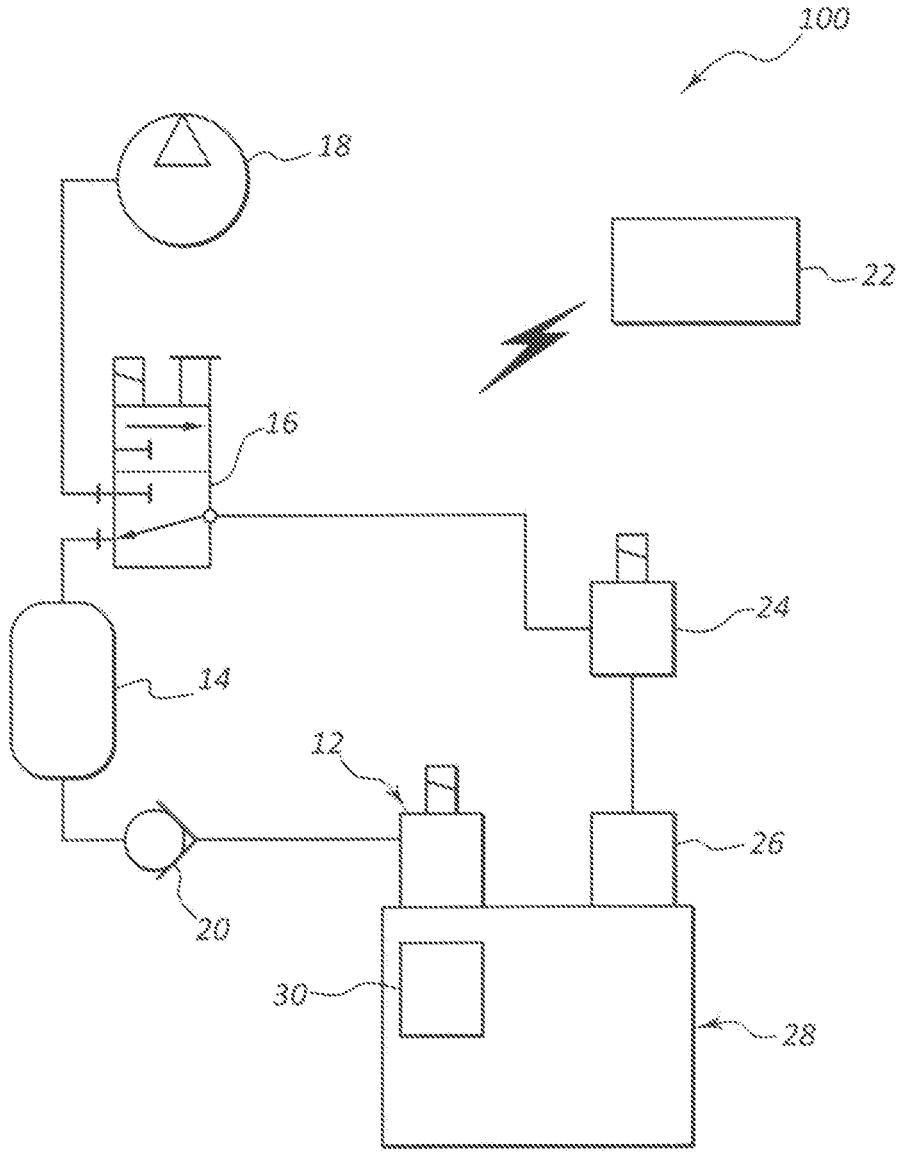
FIG. 2 is a schematic diagram showing another example air charging system in accordance with the present disclosure.

Referring now to FIG. 2, another example air charging system 100 includes a different arrangement for the accumulator 14 relative to control valve 16. FIG. 2 shows the accumulator 14 in the supply line between the charge valve assembly 12 and the control valve 16. The control valve 16 operates to receive air flow from either the accumulator 14 or the compressor 18, and deliver the compressed air to the air metering device 24. The control valve 16 shuttles between the accumulator 14 and the compressor 18 as the source of compressed air.

As noted above, FIG. 3 shows an air charging system 200 in which the accumulator 14 is integrated as a portion or a component of engine 28. In other arrangements, other features or components of air charging system 200 may be integrated into engine 28 or combined with each other to provide, for example, a more compact, less complex system having fewer parts.

Figure 4B:
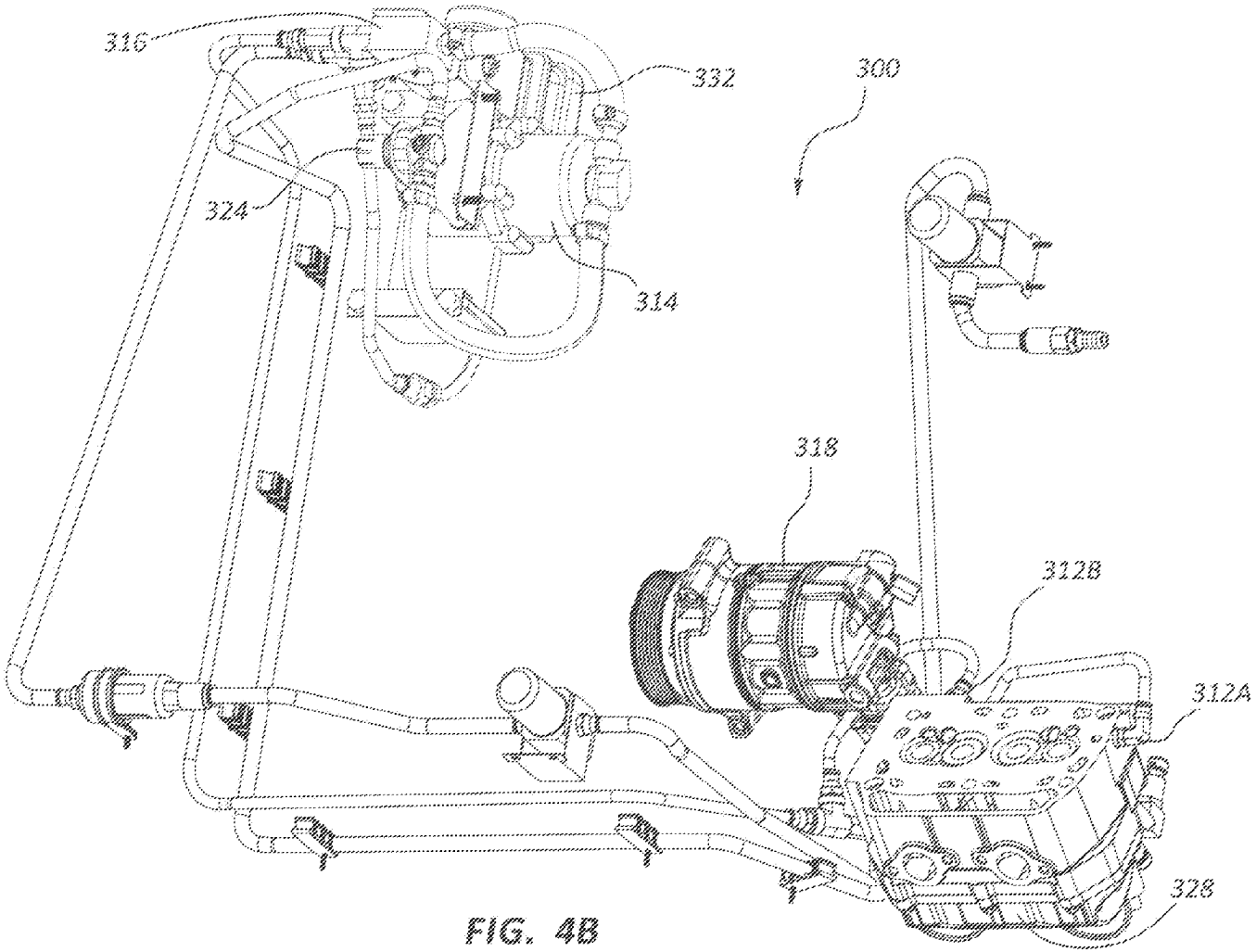

FIGS. 4A and 4B show another example air charging system 300 that is similar in some respects to the schematic air charging system 10 described above with reference to FIG. 1. Air charging system 300 includes first and second charge valve assemblies 312A, 312B, an accumulator 314, a control valve 316, a compressor 318, an air metering device 324 (also referred to as a pressure regulator), and a pressure sensor 334. The air charging system 300 may be connected to first and second fuel delivery devices 326A, 326B, which are mounted to an engine 328. The compressor 318 may be a mechanical, engine driven compressor that operates to provide compressed air after the engine 328 is operating. The air charging system 300 may further, or alternatively, include an electric compressor 332 that may be used to generate compressed air using battery power prior to the engine starting to charge the accumulator, or after the engine is started as an alternative source of compressed air if the compressor 318 or first and second charge valve assemblies 312A, 312B are not operating properly.

The accumulator 314 is positioned in the line between control valve 316 and the first and second fuel delivery devices 326A, 326B. The first and second charge valve assemblies 312A, 312B are connected in flow communication with the control valve 316.

Figure 6:
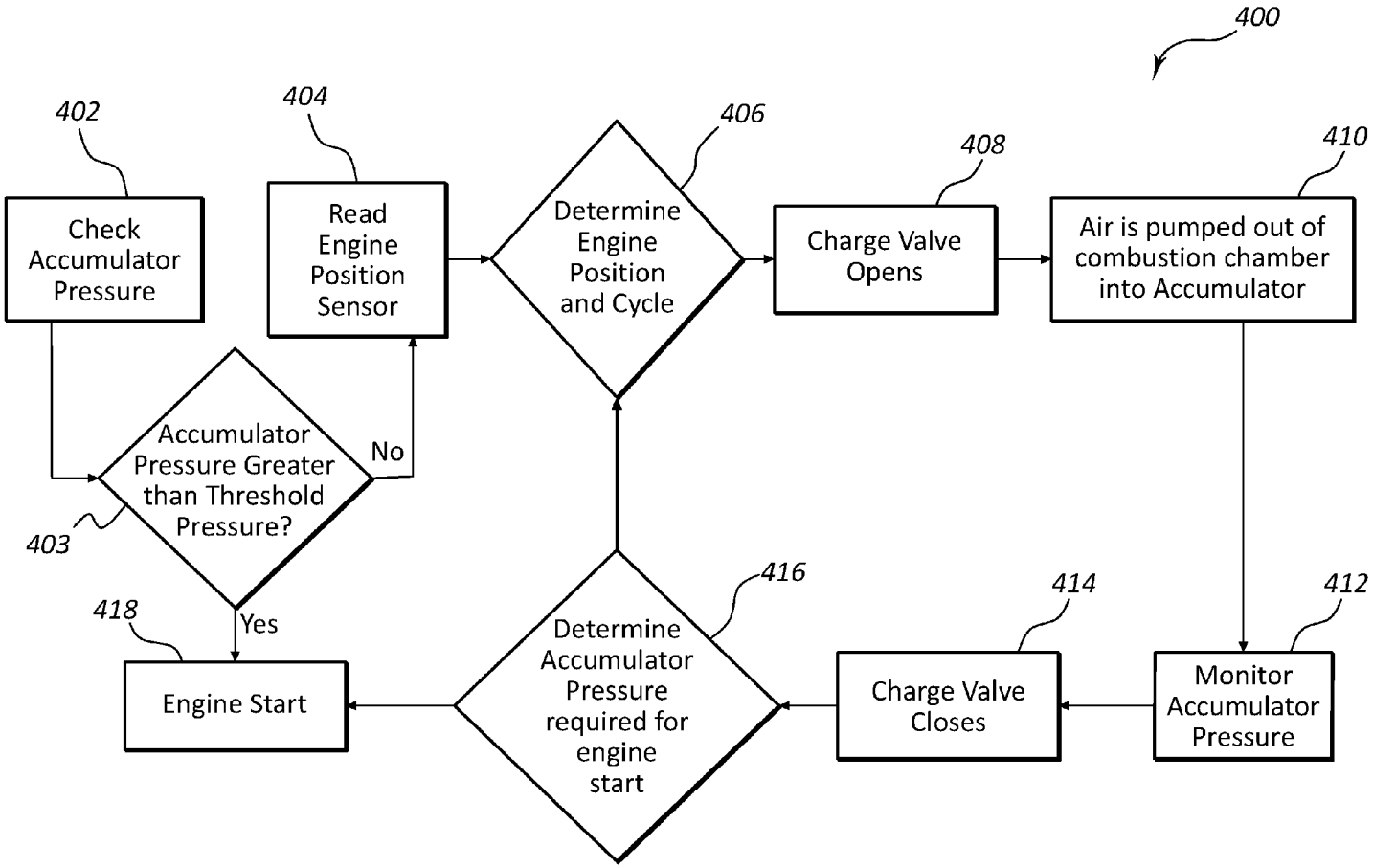
FIG. 6 shows a flow diagram of an example functional strategy in accordance with the present disclosure.

Referring to FIG. 6, an example method 400 of operating one of the air charging systems 10, 100, 200 described herein is shown. An initial step 402 of the method may include an initial pressure check within the accumulator 14. A step 403 includes determining if the accumulator pressure is above a threshold pressure level, and if so the system may automatically move to the step of starting the engine 418 by delivering compressed air from the accumulator through the air metering device to a fuel delivery device. If the pressure condition of the accumulator is lower than the threshold level, a step 404 provides reading an engine position sensor to determine an engine position and cycle in a step 406. The charge valve is open in a step 408 during a compression cycle of the engine. Air is moved out of the combustion chamber into the accumulator in a step 410 while the valve is open. The system monitors the pressure condition in the accumulator in a step 412. The charge valve closes in a step 414 when the engine is not in the combustion cycle. When the threshold pressure required for starting the engine (e.g., operating the fuel delivery device) is reached in the accumulator in a step 416, the engine is started in a step 418 by operating the fuel delivery device. If the threshold pressure is not reached in the accumulator, the system returns to step 406 to open the charge valve again to collect additional air from the combustion chamber into the accumulator.

Further steps of the method 400 may include operating the control valve after the engine starts to receive compressed air from a compressor (e.g., a mechanical or electric compressor), which is operated using power from the engine. The compressed air provided by the compressor may be used to operate the fuel delivery device to continue operation of the engine.

The air charging systems disclosed herein may be used as back-up systems for the compressor after the engine has started. For example, the compressor may malfunction during operation of the engine. The controller of the air charging system may identify that the compressor has malfunctioned (e.g., senses a drop in pressure supplied to the fuel delivery device via the air metering device), and switch the control valve 16 to receive compressed air from the charge valve assembly for ongoing operation of the engine.

In one example, the accumulator 14 may be charged with an amount of compressed gas that exceeds the amount (e.g., pressure level) needed for operating the fuel delivery device 26. The additional gases collected in the accumulator 14 may be used to operate the engine for a temporary period of time after the engine starts and before the compressor 18 is fully operational and generating sufficient compressed air to operate the fuel delivery device 26. The threshold pressure condition set for the accumulator 14 before initiating the start cycle for engine 28 may be above the minimum amount of air pressure needed to start the engine and/or initially operate the fuel delivery device.

Figure 7:
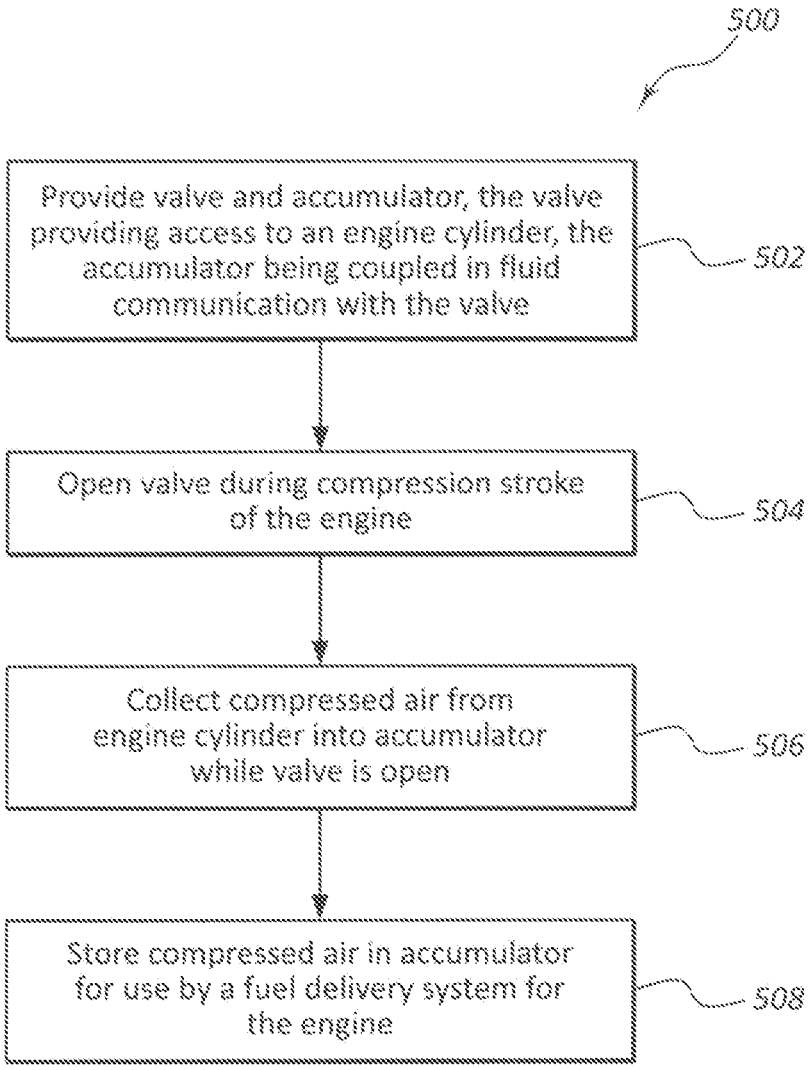
FIG. 7 shows a flow diagram of another example functional strategy in accordance with the present disclosure.

Referring now to FIG. 7, another example functional strategy or method 500 in accordance with the present disclosure includes a first operational step 502 of providing a valve and an accumulator, wherein the valve provides access to an engine cylinder and the accumulator is coupled in fluid communication with the valve. A step 504 includes opening the valve during a compression stroke of the engine. A step 506 includes collecting compressed air from the engine cylinder into an accumulator while the valve is opened. The compressed air is stored in the accumulator for later use by a fuel delivery system for delivering fuel to the engine in a step 508.

The method 500 may also include switching between the accumulator as a source of compressed air and a compressor such as a mechanical compressor that is powered by the engine after the engine is started. Alternatively, the accumulator is used to collect compressed air from either the engine cylinder or the compressor depending on an operated position of the control valve. The accumulator may act as a buffer as the amount of compressed air provided from either the engine cylinder or the compressor fluctuates prior to and after the engine starts.

The in-cylinder charge valve(s) and accumulator(s) may be used during braking to provide "regenerative braking" power by storing air compressed by the engine. The pressure buildup during compression into the accumulator provides engine braking, thus more efficient braking of the vehicle. The stored gas (e.g., air) is then routed to a pneumatic motor or other air operated driveline component to provide vehicle launch or torque assist during higher torque demand modes thus reducing fuel consumption.

Another example method in accordance with the present disclosure relates to retrofitting an engine with the air charging system. The method may include forming (e.g., drilling) a valve opening and valve seat in the housing in which the engine cylinder is formed. The valve member is mounted to the engine and operable in the valve opening to control flow of gases from the engine cylinder 30 to the accumulator 14. The accumulator 14 is coupled in flow communication with the air metering device 24 and the air metering device 24 is coupled in flow communication with the fuel delivery device 26. The compressor 18 may also be coupled in flow communication with the air metering device 24. A control valve may be positioned in the flow line between the charge valve and the accumulator, or between the accumulator and the air metering device as described above with reference to FIGS. 1 and 2.

One advantage associated with using the air charging systems disclosed herein is facilitating engine starting using the engine as an air pump during engine cranking, thereby eliminating the need for a separately powered air source during start up of the engine.

Another potential advantage is mitigating the risks associated with attempting to store compressed air for use by a fuel delivery device during start up of an engine. Dissipation of stored air may result from permeability of the storage device or leaks in the system that may occur when the engine is not running. Dissipation of the stored air charge would other inhibit operation of a dual fluids fuel delivery device. The air charging systems disclosed herein may avoid reliance upon stored compressed air by collecting a volume of compressed air while cranking the engine during or just before starting.

Another potential advantage relates to eliminating the need for an electrical pump to charge the accumulator or otherwise supply compressed air to the fuel delivery device prior to starting the engine. Avoiding the use of an electric pump may conserve battery capacity that may otherwise be needed for operation of the engine and other components such as components of a vehicle that carries the engine.

A further potential advantage may relate to implementation of a mechanical, engine driven compressor pump to provide a source of compressed air after the engine is started. The use of a mechanical compressor pump may be advantageous where there is limited electrical load available.

A still further potential advantage relates to the added functionality provided by the air charging system with relatively little or no increased reciprocating mass, parasitic load or inertia.

A dual fluids system may be ideal for employing a variety of oxidants and mixtures tailored to a specific mission.

The preceding description has been presented only to illustrate and describe certain aspects, embodiments, and examples of the principles claimed below. It is not intended to be exhaustive or to limit the described principles to any precise form disclosed. Many modifications and variations are possible in light of the above disclosure. Such modifications are contemplated by the inventor and within the scope of the claims. The scope of the principles described is defined by the following claims.

What is claimed is:

1. An air charging system, comprising:

a valve providing access to an engine cylinder;

an accumulator coupled in flow communication with the valve;

a controller operable to open the valve during engine start cranking to provide a source of pressurized air to the accumulator until a threshold pressure condition is reached in the accumulator.

2. The air charging system of claim 1, wherein the valve includes a poppet valve.

3. The air charging system of claim 2, wherein the poppet valve is biased into a closed position.

4. The air charging system of claim 1, wherein the controller operates to control flow of compressed air stored in the accumulator to a fuel delivery system, which uses the compressed air to generate a fuel charge for at least one engine firing sequence.

5. The air charging system of claim 1, wherein the controller operates to control flow of compressed air stored in the accumulator to a fuel delivery system.

6. The air charging system of claim 1, wherein the accumulator includes a cylindrical storage tank.

7. The air charging system of claim 5, wherein the accumulator holds a volume of compressed air sufficient for at least one engine firing sequence.

8. The air charging system of claim 2, wherein the valve includes a poppet valve opening in the cylinder that is arranged outward opening.

9. The air charging system of claim 1, further comprising a solenoid configured to move the valve between opened and closed positions.

10. A method of scavenging compressed air from an engine cylinder, comprising:

providing a valve and an accumulator, the valve providing access to the engine cylinder, the accumulator being coupled in flow communication with the valve;

opening the valve during an engine compression stroke;

collecting compressed air from the cylinder into the accumulator while the valve is opened;

storing the compressed air in the accumulator for use in a fuel delivery system, the fuel delivery system including a dual fluid injector.

11. The method according to claim 10, further comprising closing the valve upon reaching a predetermined pressure condition in the accumulator.

12. The method according to claim 10, further comprising closing the valve upon completion of the engine compression stroke.

13. The method according to claim 10, wherein the valve includes a valve opening directly into the cylinder, a valve seat positioned within the cylinder, and a poppet valve movable into and out of sealing contact with the valve seat.

14. The method according to claim 10, further comprising biasing the valve into a closed position.

15. A method of starting an engine, comprising:

providing an air charging system and a fuel delivery system, the air charging system including a valve configured to access a power cylinder of the engine, and an accumulator connected in flow communication with the valve and the fuel delivery system;

opening the valve during a compression cycle of the engine;

collecting compressed air from the cylinder into the accumulator;

delivering the compressed air from the accumulator to the fuel delivery system, the fuel delivery system including a dual fluid injector;

delivering fuel from the fuel delivery system to the cylinder to start the engine.

16. The method of claim 15, further comprising closing the valve after completing the compression cycle of the engine.

17. The method of claim 15, further comprising closing the valve after a predetermined pressure condition is reached in the accumulator.

18. The method of claim 15, further comprising delivering the compressed air to the fuel delivery system only after a predetermined pressure condition is reached in the accumulator.

19. The method of claim 15, further comprising shutting off the compressed air from the accumulator to the fuel delivery system after the engine is started.

20. The method of claim 17, further comprising using multiple compression cycles of the engine prior to starting the engine to reach the predetermined pressure condition in the accumulator.

21. The method of claim 15, further comprising providing a solenoid to operate the valve between opened and closed positions based on a compression cycle of the cylinder and a pressure condition in the accumulator.

* * * * *